United States Patent [19]

Brooks, Jr.

[11] 4,252,063

[45] Feb. 24, 1981

[54] SUPPORT WALKER FOR ORTHOPEDIC PATIENTS

[76] Inventor: William A. Brooks, Jr., 136 W. 3300 South, Salt Lake City, Utah 84115

[21] Appl. No.: 969,082

[22] Filed: Dec. 13, 1978

[51] Int. Cl.[3] ..... E01B 13/00

[52] U.S. Cl. ..... 104/89; 104/1 R; 272/70; 128/25 R

[58] Field of Search ..... 104/89, 93, 94, 95, 104/1 R; 105/148, 150; 119/96; 272/70; 35/29 R, 29 C; 128/25 R

[56] References Cited

U.S. PATENT DOCUMENTS

| | | | |
|---|---|---|---|
| 2,115,135 | 4/1938 | Benbow | 104/89 |
| 2,821,146 | 1/1958 | Mahrle et al. | 104/89 |
| 3,780,663 | 12/1973 | Pettit | 104/1 R |
| 3,985,082 | 10/1976 | Barac | 104/89 |

*Primary Examiner*—Richard A. Bertsch

*Attorney, Agent, or Firm*—Thorpe, North, Western & Gold

[57] ABSTRACT

A support walker comprising a horizontal rail having multiple sides in opposing orientations as track surfaces for a tracking carriage which traverses the rail. The tracking carriage circumscribes the rail and has pairs of radially disposed rollers mounted at the interior surfaces of the carriage in positions such that the pairs of rollers are in opposing contact with opposing track surfaces of the rail. The tracking carriage is thereby restricted to parallel movement in relation to the rail, with minimal play in a radial direction. A restraining vest is coupled to the tracking carriage by straps which connect at front, back and side sections of the vest. The vest further includes rigid stays which assist in maintaining the patient in upright orientation during therapy.

9 Claims, 3 Drawing Figures

SUPPORT WALKER FOR ORTHOPEDIC PATIENTS

BACKGROUND OF THE INVENTION

1. Field of the Invention

The subject invention pertains to therapeutic equipment useful to support a patient during ambulation therapy, wherein the patient provides force for movement of the support apparatus. More particularly, this invention relates to such support apparatus which operate only as stabilizing means to prevent fall or loss of balance to a patient attempting to walk on his own strength.

2. Prior Art

Various types of therapy devices have been developed to assist patients in strengthening muscle tone and coordination required to walk without assistance of crutches or other support means. Until such strength and balance is developed, the patient must be assisted by a physical therapist or some form of apparatus which supports the patient in upright position and prevents fall due to loss of balance or physiological weakness. Two basic classes of devices have emerged which are distinguished by the use or absence of a propelled carriage.

U.S. Pat. Nos. 3,780,663 and 3,985,082 disclose two types of propelled devices used to regulate a patient's walking speed, while supporting the patient in a standing position.

Although the apparatus of these disclosurers is useful in certain applied fields of therapy, several disadvantages remain. Of primary concern is the constant requirement for regulation of speed in accordance with the capacity of the patient under therapy. Frequently, such patients are unable to pace themselves and therefore they require the assistance of a physical therapist. Furthermore, variation of speed by the patient is limited due to the fixed drive movement associated with such devices. In other words, the patient is not free to move at his own pace, but is carried by the machine in accordance with a preset speed. The consequence is a lack of sense of accomplishment inasmuch as the machine is primarily the cause of forward movement. In addition, the excessive cost of such apparatus usually precludes installation within a home or other temporary location of therapy. Also, the inventor herein has noted a strong reluctance for small children to be comfortable with such power-driven units whose complexity tends to create fear and distrust within the inexperienced child.

A third embodiment of power-driven orthopedic devices is disclosed in U.S. Pat. No. 2,871,915. This device comprises a continuous chain as opposed to the use of rollers on a track, as developed in the previous two references. The latter patent includes disclosure of a frame to stabilize the patient in upright position during ambulation therapy. Here again, there is little flexibility of movement for the patient under therapy, in view of the regulated speed imposed by the power-driven apparatus. In addition, the noise is often disconcerting to a young child as is the associated complex structure. These psychological influences may be quite serious where the child is of limited mental capacity. These factors may combine to discourage the regular use of such therapeutic equipment, or at least build strong resistance within the child toward cooperation.

Under such circumstances a preferred therapeutic apparatus would be without a power source and associated propulsion hardware. A form of this class of device is disclosed in U.S. Pat. No. 2,478,004. The structure of this apparatus consists basically of a horizontal cylindrical track which carries a single roller assembly along its length. The roller is grooved to track along the cylindrical rail in response to force supplied by the patient during therapy. The disclosed structure provides the simplicity and portability for use with retarded children; however, it fails to provide a smooth motion which helps to assist the patient in developing rhythm and coordination.

Because of its structure, the subject apparatus tends to jump or lunge in an irregular fashion, tending to disrupt the balance and relaxed composure of the patient. This irregular forward motion is further coupled with side-to-side motion resulting from rotation of the roller and carrier about the longitudinal axis of the cylindrical track.

Furthermore, each of the aforementioned patents provides frame or harness structure which is somewhat problematic. None of the harnesses will provide rigid support to the upper torso of the patient when the apparatus has any substantial slack. Such slack may be, at times, desirable to give full opportunity to the patient to walk somewhat independently of the apparatus, such apparatus being present only to support the patient in the event of fall or loss of balance. With retarded children, the problem of imbalance encourages additional fears against using such equipment on a regular basis. Without the security of upright support, the patient must be conscious of upper torso muscular control, as well as the complex muscle regulation required to walk. In early stages of ambulation therapy, it may be preferable to relieve the patient of concern for balance and muscular coordination for his upper torso, freeing his attention to concentrate on leg movement.

OBJECTS AND SUMMARY OF THE INVENTION

It is therefore an object of the subject invention to provide a free-movement support walker which develops smooth movement of the carriage along the support rail.

It is a further object of the present invention to provide a stable tracking carriage for use with a support walker which moves gently with the patient in response to efforts by the patient.

It is yet another object of this invention to provide a walker harness which develops improved stability to the patient.

These and other objects are realized in a support walker comprising a horizontal rail defining a directional path for movement of the patient to be assisted during ambulation therapy. This rail includes a plurality of sides having opposing orientation and being operable as track surfaces along a length of the rail. A tracking carriage circumscribes the rail and includes a plurality of radially disposed forward and rearward rollers oriented for movement along the directional path defined by the rail. These rollers are mounted at interior surfaces of the carriage in positions such that pairs of said rollers are in opposing contact with the track surfaces. The support walker also includes a restraining vest having rigid stays along back, front and side sections thereof to maintain the patient in upright orientation during therapy. Special rigid stays are provided for attachment to the patient's legs and include an arcuate track to enable the patient to lift his legs. This vest is coupled to the tracking carriage by straps that attach at front, back and side locations of the vest.

Contact pressure by the rollers at the tracking surfaces can be adjusted by rotating mounting bolts which hold the rollers in position. The rollers are thereby urged into tighter contact with the surface to increase resistance toward movement of the carriage. This type of adjustment permits the carrier to be adapted to free-movement or to resistive movement, depending upon the amount of drag adjusted at the rollers.

The substantial limitation of the tracking carriage to near-parallel movement with respect to the rail provides added stability to the apparatus, giving the patient an increased sense of security and safety. In addition, the size and bulk of the tracking carriage develop a forward momentum during movement which minimizes jerking response of the carriage. The resulting smooth-flow movement improves the patient's ability to develop a more natural walking rhythm.

Additional objects and features of the subject invention will be apparent to those skilled in the art, when taken in combination with the following detailed description and figures, in which.

DETAILED DESCRIPTION OF THE INVENTION

Figure 1:
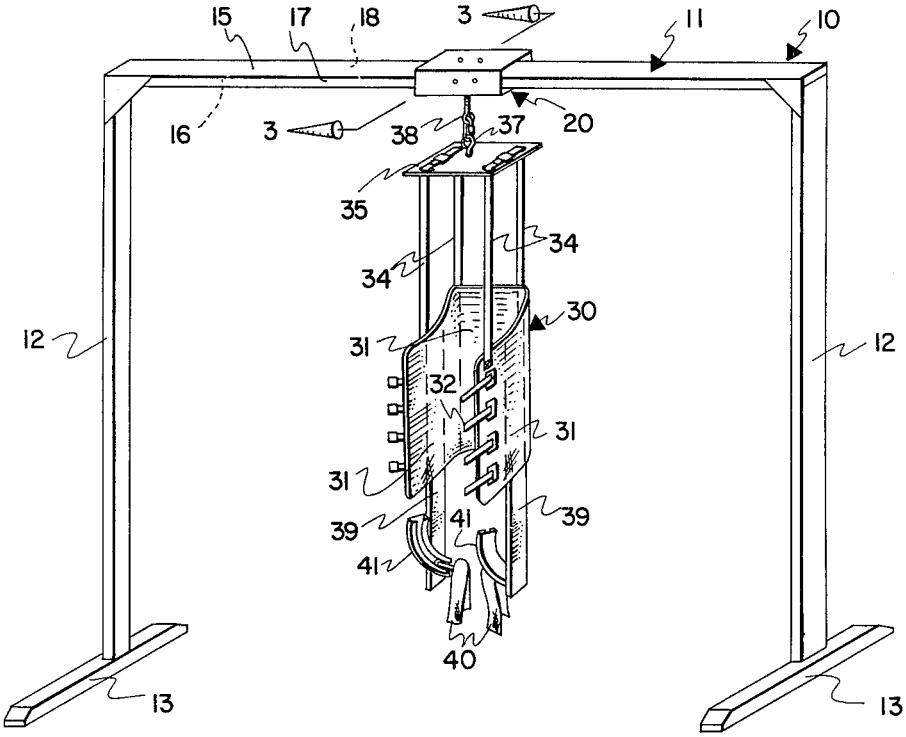
FIG. 1 is a perspective view of the subject support walker with attached vest.

Referring now to the drawings:

A support walker 10 is shown generally in FIG. 1 and includes a horizontal rail 11 supported by a pair of stationary beams 12, each of which rests on a base member 13. This same horizontal rail 11 could be stabilized between two walls with mounting brackets or could be suspended from a ceiling by some form of rigid support. The preferred construction would be of heavy metal such as steel to develop the desired sturdiness to support a patient during ambulation therapy. It is important that this frame by very stable to encourage a sense of security to the patient subject to therapy. The selection of values for height above ground level and rail span will naturally depend upon the size of the patient.

The rail functions to define a directional path for movement and has a plurality of sides which operate as track surfaces to support a moving carriage. It is preferred that the rail have pairs of sides with opposing orientation such as top 15 and bottom 16, as well as sides 17 and 18. Although the illustrated rail consists of a rectangular cross-section with two pairs of opposing sides, it will be apparent that other configurations may be suitable such as a triangular configuration in which each side is opposed by two oblique sides.

Figure 2:
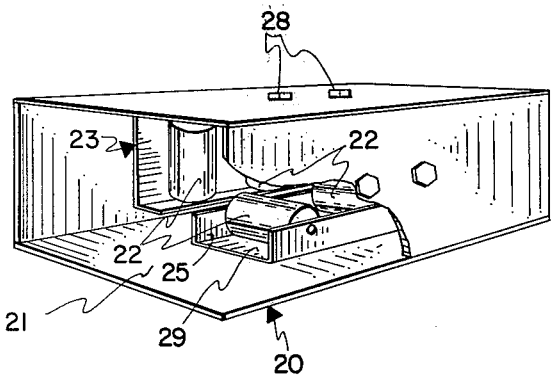
FIG. 2 is a partial cutaway, perspective view of the tracking carriage.
Figure 3:
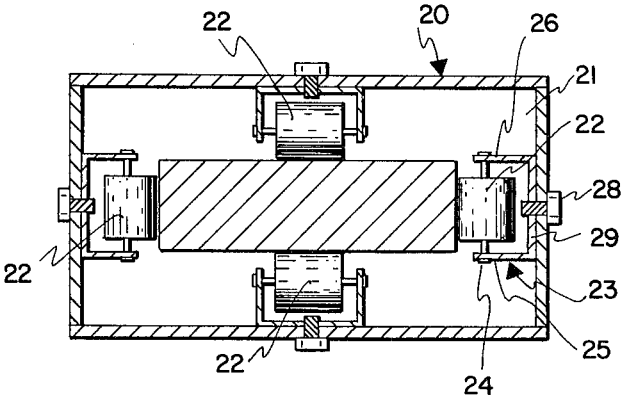
FIG. 3 is a cross-section taken along the line 3-3.

The respective sides of the rail 11 function as tracks for a tracking carriage 20 which encloses the rail 11. The tracking carriage will usually be configured to conform with the geometric cross-section of the rail for reasons which will be explained hereinafter. Each side of the rail would therefore have a corresponding interior surface 21 of the tracking carriage which will carry rollers 22 to suspend the carriage in circumscribing relationship around the rail. These rollers are radially disposed in relation to and in contact with the rail such that the direction of rotation of each wheel is substantially perpendicular to the tracking surface upon which it rides. In this configuration the rail 11 is sandwiched between opposing pairs of rollers to enable stabilized free-movement of the carriage along the rail. Pairs of rollers are used as illustrated in FIG. 2 to prevent rotational motion of the carriage as it traverses the rail. The carriage is thereby fixed with respect to the rail and can move only in substantial parallel orientation therewith.

Although the rollers may be mounted in numerous ways, the use of a channel mount 23 is suggested. Each roller 22 is journaled on an axle 24 which is supported by opposing legs 25 and 26 of the channel mount 23. The channel mount 23 has sufficient length to permit the placement of both a forward and rearward roller to develop the required stability. The channel member 23 is mounted at the interior surface 21 of the carriage 20 by means of mounting bolts 28 which are rotatably anchored at the carriage wall. These bolts 28 are rotatably fixed at the carriage to prevent displacement therefrom during rotation of the bolt.

The web section 29 of the channel member has two threaded openings corresponding to the size and location of the respective mounting bolts. Each of the mounting bolts is threaded through the corresponding opening in the channel mount and is used to adjust a relative displacement of the channel mount away from the interior surface of the carriage. Such adjustment permits the imposition of the rollers against the respective tracking surfaces at variable pressures. The degree of free-movement for the carriage can thereby be regulated by adjusting one or more of the mounting bolts 28 to increase or decrease the applied tension through the rollers.

The patient is attached to the tracking carriage by means of a harness or vest 30 which wraps around the upper torso of the patient. Added stability is provided where the vest is reinforced with rigid stays 31 (phantom lines) which maintain the upper torso and head in upright orientation. The vest 30 is secured around the patient by means of straps 32 or other fastening means of suitable form.

The vest is coupled to the carrier by means of straps 34 which are connected at upper sections of the vest and at a support plate 35. The support plate 35 functions to maintain the respective vest straps 34 at a spacial separation to prevent entanglement and discomfort to the patient. The straps 34 are of sufficient length so that the upper torso and head of the patient are underneath but out of contact with the plate 35.

The plate 35 is coupled to the tracking carriage 20 by means of a tether cord or chain 37 and eye bolt 38. The eye bolt is adjustable with respect to the tracking carriage to permit adjustment of height of the patient above ground level during therapy.

Additional support is given to the patient by the use of a lower pair of stays 39 which attach at a lower section of the vest and extend to the lower high region of the patient. A means of attachment 40 is provided to secure the stays 39 along the thigh region. This configuration relieves strain at the underarms of the patient as he tends to hang in the vest. A pair of arcuate tracks 41 are fixed at ends of the stays 39 such that each track opening faces the patient's upper legs. The arc of each track curves upward in an arc corresponding to the raised movement path of the patient's leg at the point of attachment during walking motion, to enable the patient to lift his leg during therapy. Straps 40 are fixed to tracking means or rollers mounted within the track 41 and are anchored to the legs. In the illustrated embodiment, the straps are attached to projecting extensions of roller axles to provide free movement when moving the leg.

The subject invention is utilized by placing the patient under the plate 35 and fastening the vest 30 around the upper torso. The thigh stays 39 are then secured in place by straps 40 to properly stabilize the patient in upright orientation. The patient is able to remain substantially relaxed in view of his fixed upright orientation, and therefore need only be concerned with coordination and movement of leg muscles. The height of the patient at ground level is appropriately adjusted and the patient is released to develop his own coordination and movement along the directional path fixed by the rail.

When tension is released from the respective pairs of rollers, the carriage will move forward at the slightest urge or force of the patient. The absence of rotational motion of the carriage prevents erratic motion, and tends to develop improved rhythm and response of the patient. Because of the weight and size of the tracking carriage, forward motion is accompanied by sufficient momentum to further enhance the smooth, nonjerking progress of the tracking member along the rail.

The subject invention has been experimentally shown to provide excellent therapy environment and assistance for children. When applied to a retarded child who was without capability to walk, its use in regular therapy enabled the child to develop all of the necessary muscular coordination and balance within a short therapy period of six months. The success of this invention is due not only to the structural features explained herein, but arises in part from the willingness of the patient to participate in such therapy. The simple structure avoids creating any fear or distress in the patient and provides a sense of safety and security required during this learning stage. In addition, the patient receives a regular sense of satisfaction because of progress which is more noticeable when the patient applies his own motive force, as opposed to being carried along a rail by a motor-driven means.

Although preferred forms of this invention have been disclosed herein, it will be apparent to one skilled in the art that numerous modifications can be incorporated without departing from the inventive subject. It is therefore to be understood that the specific structure illustrated is by way of example only and that no limitations should be derived therefrom, except as may be incorporated in the following claims.

I claim:

1. A support walker comprising:

(a) a horizontal rail defining a directional path for movement of a patient to be assisted during ambulation therapy, said rail having a plurality of sides in opposing orientation and operable as track surfaces along a length of said rail;

(b) a tracking carriage circumscribing said rail and having a plurality of radially disposed forward and rearward rollers oriented for movement along said directional path and mounted at interior surfaces of said carriage in positions such that pairs of said rollers are in opposing contact with said track surfaces to thereby adapt said carriage for substantial parallel movement with respect to said rail;

(c) a restraining vest having ridig stays along back, front or side sections thereof to maintain the patient in upright orientation when positioned therein; and (d) means for coupling said vest to the tracking carriage such that the vest is supported at front, back and side locations in upright orientation.

2. A support walker as defined in claim 1, wherein said carriage includes a rectangular enclosure having four interior sides, each interior side having a forward and rearward roller mounted thereon in opposing contact at said rail with a comparable pair of rollers at an opposite side of the enclosure.

3. A support walker as defined in claim 1, wherein the tracking carriage includes adjustable means for mounting said rollers to permit radial displacement thereof to change contact pressure of said roller at the tracking surface and thereby vary resistance of the carriage to movement.

4. A support walker as defined in claim 3, wherein said adjustable means includes a channel mounting bracket with threaded openings corresponding in size to threaded mounting bolts fixed at sides of the carriage in radial orientation and engaged in said threaded openings to thereby permit displacement of the channel in response to rotation of said bolt, said rollers being journaled within the channel in common radial orientation with the mounting bolts.

5. A support walker as defined in claim 2, wherein the rail has four sides, each side being substantially parallel to an opposing side and having a rectangular cross-section corresponding to a rectangular cross-section of the enclosing carriage.

6. A support walker as defined in claim 1, wherein said stays extend along the length of said vest and include an additional pair of stays extending from the vest to lower stay locations corresponding to upper leg locations, with means for attachment as said leg locations to give added patient support.

7. A support walker as defined in claim 6, wherein said additional stays further comprise an arcuate track attached to the lower stay location, said track curving upward in accordance with a raised movement path of the patient's leg at the point of attachment of said lower stay, said track having tracking means coupled thereto and attached to straps for fixation at the patient's upper leg.

8. A support walker as defined in claim 7, wherein said tracking means comprises a rollwer movably disposed within said track and coupled at its axis to said leg strap.

9. A support walker as defined in claim 1, wherein vest coupling includes a rectangular plate having straps for attachment at front, back and side locations on the vest, said straps being of sufficient length to clear the patient's head during use, said plate having adjustable means for attachment to said tracking carriage.

* * * * *